US009447707B2

(12) United States Patent
Kretschmer et al.

(10) Patent No.: US 9,447,707 B2
(45) Date of Patent: Sep. 20, 2016

(54) HYDRAULIC SUPPORT ELEMENT

(71) Applicant: Schaeffler Technologies AG & Co. KG, Herzogenaurach (DE)

(72) Inventors: Jürgen Kretschmer, Fürth (DE); Peter Sailer, Erlangen (DE); Wolfgang Christgen, Seukendorf (DE); Matthew Evans, Warren, MI (US); David Kehr, Oxford, MI (US); Chad Lee, Troy, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/708,879

(22) Filed: May 11, 2015

(65) Prior Publication Data

US 2015/0330269 A1 Nov. 19, 2015

Related U.S. Application Data

(60) Provisional application No. 61/992,546, filed on May 13, 2014.

(51) Int. Cl.

| | |
|---|---|
| ***F01L 1/24*** | (2006.01) |
| ***F01L 1/18*** | (2006.01) |
| ***F01L 9/02*** | (2006.01) |

(52) U.S. Cl.

CPC .. *F01L 1/18* (2013.01); *F01L 9/02* (2013.01); *F01L 1/2405* (2013.01); *F01L 2001/2433* (2013.01); *F01L 2103/00* (2013.01); *F01L 2109/00* (2013.01)

(58) Field of Classification Search

CPC ..... F01L 1/2405; F01L 2001/2433; F01L 2103/00; F01L 2109/00; F01L 9/02

USPC ..... 123/90.15, 90.46, 90.55, 90.56, 90.57

See application file for complete search history.

(56) References Cited

U.S. PATENT DOCUMENTS

| | | | | |
|---|---|---|---|---|
| 6,039,017 A * | 3/2000 | Hendriksma | ..... | F01L 1/2405 123/90.19 |
| 2014/0283776 A1* | 9/2014 | Smith | ..... | F01L 1/2416 123/90.46 |

FOREIGN PATENT DOCUMENTS

| | | |
|---|---|---|
| DE | 10330510 A1 | 1/2005 |
| DE | 102008038792 A1 | 2/2010 |

* cited by examiner

*Primary Examiner* — Jorge Leon, Jr.

(74) *Attorney, Agent, or Firm* — Antun M. Peakovic

(57) ABSTRACT

The invention relates to a hydraulic support element for valve drive of a combustion engine, with a pot cylindrical casing and a hollow cylindrical piston guided axially movably therein, the inner end of which is supported via a spring on the bottom wall of the casing, whose outer end projects past the outer margin of the casing and is formed as a hemispherical bearing head, and whose inner space is subdivided by means of a partition element into an axially inner supply-pressure space and an axially outer switching-pressure space.

14 Claims, 12 Drawing Sheets

HYDRAULIC SUPPORT ELEMENT

TECHNICAL FIELD

The invention relates to a hydraulic support element for a valve drive of a combustion engine.

SUMMARY OF THE INVENTION

The invention relates to a hydraulic support element for a valve drive of a combustion engine, with a pot cylindrical casing and a hollow cylindrical piston guided axially movably therein, the inner end of which is supported via a spring on the bottom wall of the casing, whose outer end projects past the outer margin of the casing and is formed as a hemispherical bearing head, and whose inner space is subdivided by means of a partition element into an axially inner supply-pressure space and an axially outer switching-pressure space, wherein the supply-pressure space can be connected via a non-return valve to a high-pressure space enclosed between the inner end of the piston and the bottom wall of the casing, and wherein the switching-pressure space is connected via a central bore arranged in the bearing head to a switching-pressure line of a switchable rocker arm.

In the installed state, the hydraulic support element is inserted, as is known, in a substantially vertically oriented blind bore of a cylinder head of the combustion engine, into whose cylindrical bore wall axially further inward a first supply line and axially further outward a second supply line lead. The supply-pressure space of the piston is then in connection with the first supply line via first openings in the cylindrical side walls of the piston and of the casing of the hydraulic support element. The switching-pressure space of the piston is correspondingly in connection with the second supply line via second openings in the cylindrical side walls of the piston and of the casing.

Hydraulic support elements are used in valve drives of combustion engines in which the gas exchange valves, such as intake and exhaust valves, are actuated via rocker arms used in conjunction with a rotating camshaft. The respective rocker arm is at one end in connection with the outer end of the valve shaft of at least one gas exchange valve and at the other end on the same side is mounted swivelably on the casing of the cylinder head via a hydraulic support element. Between the two ends, the rocker arm, on the side facing away from the gas exchange valve and the support element, is in contact with at least one cam lobe of a camshaft. During a rotation of the camshaft, the rocker arm is swiveled, in accordance with the lift contour of the cam lobe, around the bearing on the support element in the direction of the gas exchange valve or under the action of the valve spring in the opposite direction, as a result of which the gas exchange valve is opened and closed.

If the support element is loaded, its piston is pressed axially into the casing, as a result of which a high pressure is built up in the high-pressure space, by means of which the non-return valve is kept closed and, in connection with the incompressible hydraulic oil located in the high-pressure space, a rigid connection between the piston and the casing is formed. If there is no load on the support element, its piston is axially pressed by the spring out of the casing, and as a result any free play present in the valve drive is compensated. In the process, a negative pressure develops in the high-pressure space, as a result of which the non-return valve is opened, and the hydraulic oil can flow from the supply-pressure space into the high-pressure space in order to compensate for leakage losses.

In the so-called double-flow support element of the above-described design, there is, in addition to the support and play compensation functions, also the supply of a switching pressure into a switchable rocker arm. For example, in a switchable rocker arm, in order to disconnect the gas exchange valve, a locking bolt of a swivelable cam follower, which can be moved against a return spring, can be pressed out of its locking position as a result of a decreased switching pressure, so that the gas exchange valve in question is no longer open. It is equally possible to press, in a switchable rocker arm for variable valve control, a locking bolt of two swivelable cam followers for adjacent cam lobes with different lift contours, locking bolt which can be moved against a return spring, as a result of an increased switching-pressure, from a locking position for the first cam follower into a locking position for the second cam follower, as a result of which the valve control is switched over from the lift contour of the first cam lobe of the camshaft to the lift contour of the second cam lobe. The supply of the hydraulic oil for the switching function occurs from the switching-pressure space via the central bore and a switching-pressure line arranged in the rocker arm in the bearing head of the piston. In addition, for lubricating the sliding surfaces of the bearing head and of the rocker arm, hydraulic oil is led via the central bore into the gap in question.

Since the hydraulic oil located in the supply-pressure space and the hydraulic oil located in the switching-pressure space fulfill different functions and can have different pressures, these pressure spaces located within the inner space of the piston are usually separated from one another by a partition element.

From DE 103 30 510 A1, a corresponding hydraulic support element is known, in which the partition element is formed as a pot cylindrical cap which is pressed, with axially outward directed bottom wall, until it comes in contact with an inner constriction, into a cylindrical section arranged between the openings of the piston. For the ventilation of the supply space into the switching-pressure space, at least one ventilation opening is provided, which needs to lead through the partition element or radially between said partition element and the side wall of the piston. However, no concrete indications regarding the implementation, arrangement and dimensioning of the ventilation opening can be obtained from DE 103 30 510 A1.

An additional hydraulic support element according to the preamble is described in DE 10 2008 038 792 A1. In this known support element, the partition element is formed as a sphere which is inserted between the openings of the piston in the inner space thereof and around which the cylindrical side wall of the piston winds with positive locking connection. For the ventilation of the supply space into the switching-pressure space, this sphere is held in the piston with limited movability, so that the ventilation can occur via the annular gap between the sphere and the cylindrical side wall of the piston. As an alternative to this, a ventilation channel in the winding-around area of the sphere is mentioned, which needs to lead from the supply space into the switching-pressure space. With the exception of the annular gap, no concrete indications regarding the implementation, arrangement and dimensioning of the ventilation opening can be obtained from DE 10 2008 038 792 A1 either.

The invention is therefore based on the problem of indicating, for a hydraulic support element of the design mentioned at the beginning, concrete implementations and arrangements of ventilation openings, which can be produced easily and cost effectively, as well as indications on the dimensioning and the production of the ventilation openings.

In a first solution of this problem according to the invention, the hydraulic support element of the design mentioned at the beginning has the following features: formation of the partition element as a pot cylindrical cap which, in the inner space of the piston with axially outward directed bottom wall in an inner cylindrical section of the side wall of the piston, is pressed in until it is in contact with a radially inner constriction thereof, a ventilation opening which is arranged largely centered in the bottom wall of the cap and whose cross section does not exceed a predetermined limit cross-sectional area, and an inner recess in the bottom wall of the cap, which is arranged centered and which includes the area of the ventilation opening.

Advantageous implementations and variants of this support element according to the invention are the subject matter of the associated dependent claims.

Accordingly, the invention is based on a hydraulic support element, which in itself is known, for a valve drive of a combustion engine, which has a pot cylindrical casing and a hollow cylindrical piston guided axially movably therein. The axially inner end of the piston is supported via a spring on the bottom wall of the casing. The axially outer end of the piston projects axially past the outer margin of the casing and is formed as a hemispherical bearing head. The inner space of the piston is subdivided by means of a partition element into an axially inner supply-pressure space and an axially outer switching-pressure space. The supply-pressure space can be connected via a non-return valve to a high-pressure space enclosed between the axial inner end of the piston and the bottom wall of the casing. The switching-pressure space is connected via a central bore arranged in the bearing head to a switching-pressure line of a switchable rocker arm.

In the installed state, the hydraulic support element is inserted into largely vertically aligned blind bore of a cylinder head of the combustion engine, into whose cylindrical bore wall, axially further inward, a first supply line, and, axially further outward, a second supply line lead. As a result, the supply-pressure space of the piston is in connection with the first supply line via first openings in the cylindrical side walls of the piston and of the casing. The switching-pressure space of the piston is accordingly in connection with the second supply line via second openings in the cylindrical side walls of the piston and of the casing.

In order to ensure a ventilation of the supply-pressure space into the switching-pressure space that is easy and cost effective to achieve, the partition element is formed as a pot cylindrical cap which, in the inner space of the piston with its axially outward directed bottom wall in an inner cylindrical section of the side wall of the piston, is pressed in until said cap is in contact with a radially inner constriction. Air bubbles and hydraulic oil foamed with air located in the supply-pressure space therefore accumulate in the inner space of the cap. To discharge the air and the foamed hydraulic oil into the switching-pressure space, a ventilation opening is provided, which is arranged largely centered in the bottom wall of the cap. The cross section of the ventilation opening is limited to a predetermined limit cross-sectional area, in order to prevent an exchange of hydraulic oil and pressure disturbances between the supply-pressure space and the switching-pressure space. In order to promote, within the cap, the flow of air and foamed hydraulic oil to the ventilation opening, an inner recess in the bottom wall of the cap is provided, which is arranged centered and which includes the area of the ventilation opening.

The ventilation opening can be formed by a single cylindrical bore which is arranged centered in the bottom wall of the cap. However, it is also possible for the ventilation opening to be formed by several cylindrical bores, which are arranged in a regular distribution over the bottom wall of the cap, in each case in the centroid of the surface of the associated wall sector.

The production of the bore or bores can be carried out by drilling with a spiral drill, punching out with a punching tool, or cutting out with a laser.

According to another possible embodiment, the ventilation opening is formed by a slit arranged diagonally and centered in the bottom wall of the cap. The production of the slit can be carried out by cutting out with a laser or sheering open the bottom wall and at least partial bending back of the wall section in question using a punching or pressing tool.

The inner recess in the bottom wall of the cap can be generated by an axially outward directed camber of the bottom wall and/or, in connection with preserving the outer contour of the cap, by a reduced wall thickness of the bottom wall of the cap.

The predetermined maximum total limit cross-sectional area of the ventilation opening is 0.25 $mm^2$ for use in passenger vehicle engines.

According to a second solution of the problem according to the invention, the hydraulic support element of the design mentioned in the beginning has the following features:

formation of the partition element as a pot cylindrical cap which, in the inner space of the piston with axially inward directed bottom wall, is pressed in largely centered in an inner cylindrical section of the side wall of the piston, with an axial height that projects on both sides past the cap, a ventilation channel, which is oriented axially and arranged between the cylindrical side wall of the cap and the inner cylindrical section of the side wall of the piston, and whose cross section does not exceed a predetermined limit cross-sectional area, as well as an outer bulge on the bottom wall of the cap, which is arranged centered.

Advantageous embodiments and variants of this support element according to the invention are the subject matter of the associated dependent claims.

In order to ensure a ventilation of the supply-pressure space into the switching-pressure space in a simple and cost effective manner, the partition element is formed as a pot cylindrical cap which, in the inner space of the piston with axially inward directed bottom wall in an inner cylindrical section of the side wall of the piston, is pressed with an axial height that projects on both sides past the cap. Air bubbles and hydraulic oil foamed with air located in the supply-pressure space thus accumulate preferentially on the margin between the bottom wall of the cap and the cylindrical side wall of the piston. To discharge the air and the foamed hydraulic oil into the switching-pressure space, a ventilation channel is provided, which is oriented axially and arranged between the cylindrical side wall of the cap and the inner cylindrical section of the side wall of the piston. The cross section of the ventilation channel is limited to a predetermined limit cross-sectional area, in order to prevent an exchange of hydraulic oil and pressure variations between the supply-pressure space and the switching-pressure space. In order to promote the flow of air and foamed hydraulic oil to the ventilation channel, an outer bulge on the bottom wall of the cap is provided, which is arranged centered.

The ventilation channel can be formed by several axial grooves, which are arranged in a regular distribution over the circumference, in the side wall of the cap. The production of these axial grooves can have occurred by pressing in with a pressing tool or by rolling in with a rolling tool.

Alternatively to this, the ventilation channel can also be formed by several axial grooves, which are arranged in a regular distribution over the circumference in the inner cylindrical section of the side wall of the piston and which, in order to allow the free inflow and outflow of air and foamed hydraulic oil, project axially on both sides past the cap. The production of these axial grooves can have occurred by machining away with a machining tool or by rolling in with a rolling tool.

The outer bulge in the bottom wall of the cap is preferably generated by an axially outward directed camber of the bottom wall.

The predetermined maximum total limit cross-sectional area of the ventilation opening is 0.25 $mm^2$ for use in passenger vehicle engines.

BRIEF DESCRIPTION OF DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

DETAILED DESCRIPTION OF THE INVENTION

Figure 1:
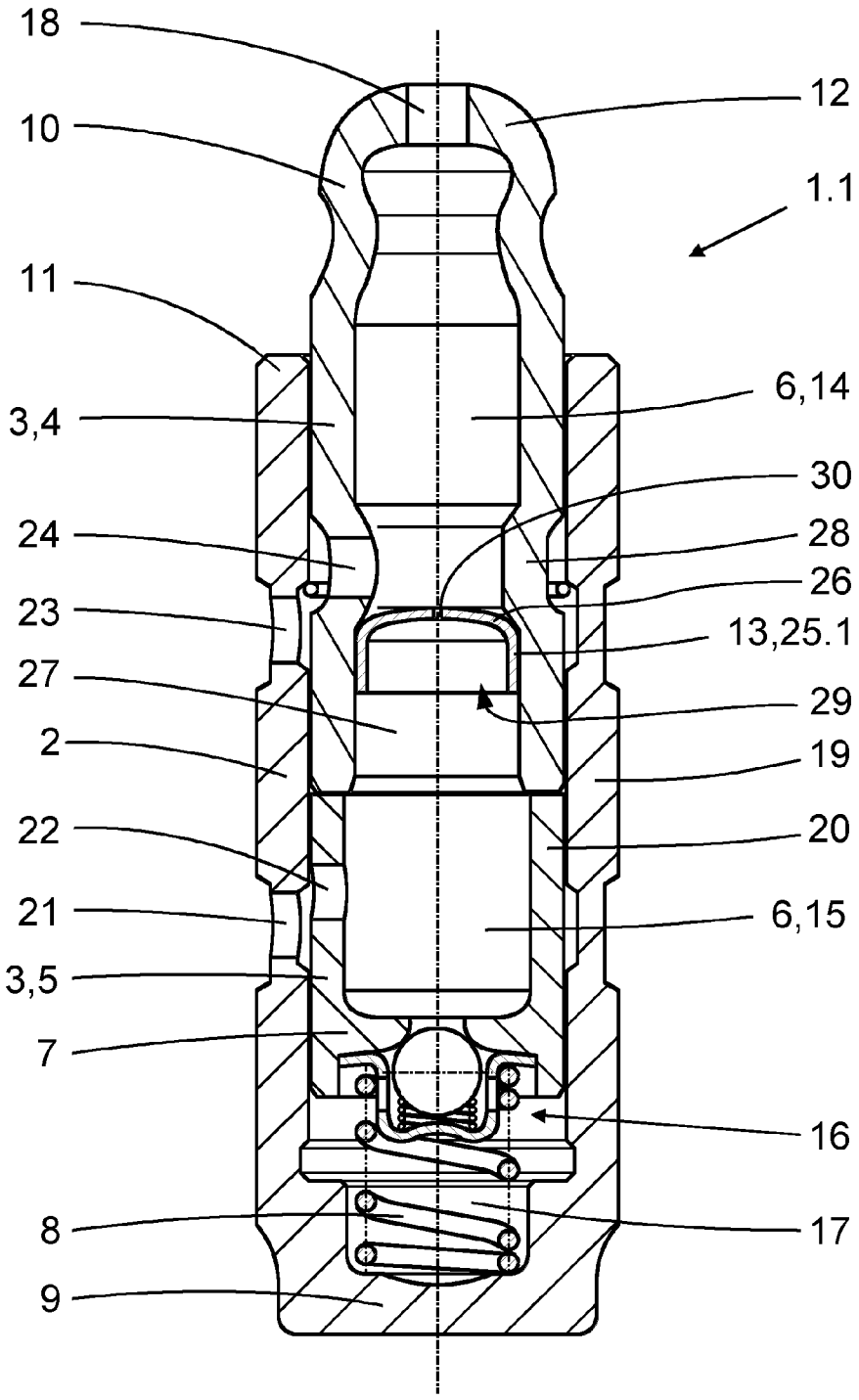
FIG. 1 shows a first variant in a first base embodiment of the support element formed according to the invention in a longitudinal central section.

In FIG. 1, in a longitudinal central section, a first variant of a first base embodiment of a hydraulic support element 1.1 formed according to the invention is represented, which is provided for a valve drive of a combustion engine. The support element 1.1 comprises a pot cylindrical casing 2 and a hollow cylindrical piston 3 guided axially movably therein. The piston 3 is here formed by two parts and composed of a pot cylindrical inner portion 5 and a largely pot cylindrical outer portion 4, which enclose an inner space 6. The inner end 7 of the piston 3 is axially supported via a spring 8 on the bottom wall 9 of the casing 2. The outer end 10 of the piston 3 projects axially past the outer margin 11 of the casing 2 and is formed as a hemispherical bearing head 12. The inner space 6 of the piston 3 is subdivided via a partition element 13 into an axially inner supply-pressure space 15 and an axially outer switching-pressure space 14. The supply-pressure space 15 can be connected via a non-return valve 16 to a high-pressure space 17 enclosed between the inner end 7 of the piston 3 and the bottom wall 9 of the casing 2. The switching-pressure space 14 is connected via a central bore 18 formed in the bearing head 12 to a switching-pressure line of a switchable rocker arm which is not represented here.

In the installed state, the hydraulic support element 1.1, in a generally known manner, is inserted in a largely vertically oriented blind bore of a cylinder head of a combustion engine, which is not represented here. Axially further inward, a first supply line and axially further outward, a second supply line lead into the cylindrical bore wall of the blind bore. The supply-pressure space 15 of the piston 3 is in connection with the first supply line via first openings 21, 22 in the cylindrical side walls 19, 20 of the casing 2 and of the piston 3.

The partition element 13 is formed as a top cylindrical cap 25.1 which, in the inner space 6 of the piston 3 with axially outward directed bottom wall 26 in an inner cylindrical section 27 of the side wall 20 of the piston 3, is pressed in until it is in contact with an inner constriction 28 of the piston 3. Air bubbles and hydraulic oil foamed with air located in the supply-pressure space 15 thus accumulate in the inner space 29 of the cap 25.1. To discharge the air and the foamed hydraulic oil into the switching-pressure space 14, a ventilation opening 30 is provided, which is arranged largely centered in the bottom wall 26 of the cap 25.1. The cross section of the ventilation opening 30 is limited to a predetermined limit cross-sectional area, in order to prevent an exchange of hydraulic oil and pressure disturbances between the supply-pressure space 15 and the switching-pressure space 14. In order to promote, within the cap 25.1, the flow of air and foamed hydraulic oil to the ventilation opening 30, the bottom wall 26 of the cap 25.1 has an inner, cambered recess 31, which is arranged centered and includes the area of the ventilation bore 30.

Figure 1A:
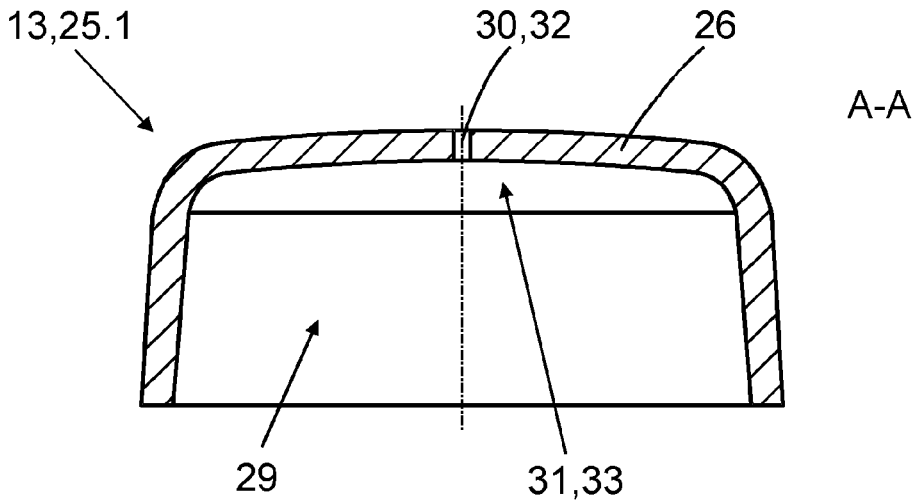
FIG. 1*a* shows the partition element of the support element according to FIG. 1 in an enlarged longitudinal central section.
Figure 1B:
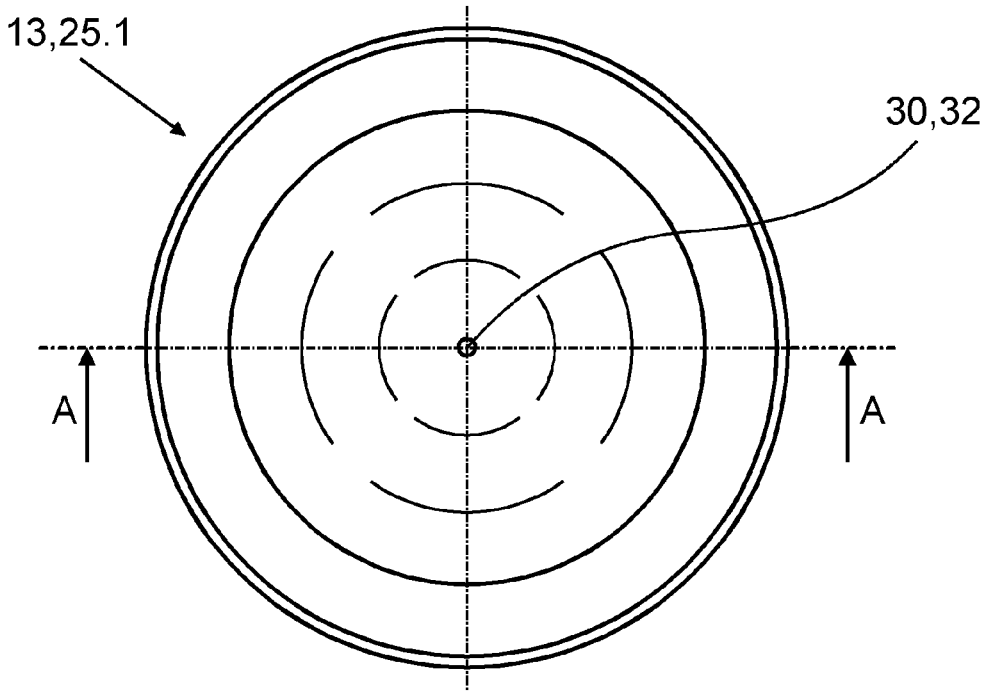
FIG. 1*b* shows the partition element of the support element according to FIGS. 1 and 1*a* in an enlarged axial view.

In the longitudinal central section of the enlarged representation in FIG. 1*a* and in the radial view of the enlarged representation in FIG. 1*b* through the cap 25.1, one can clearly see that the ventilation opening 30 is formed here by a single cylindrical bore 32, which is arranged centered in the bottom wall 26 of the cap 25.1. In these figures, one can equally see particularly well that the inner recess 31 of the bottom wall 26 of the cap 25.1 is generated here by an axially outward directed camber 33 of the bottom wall 26.

Figure 2:
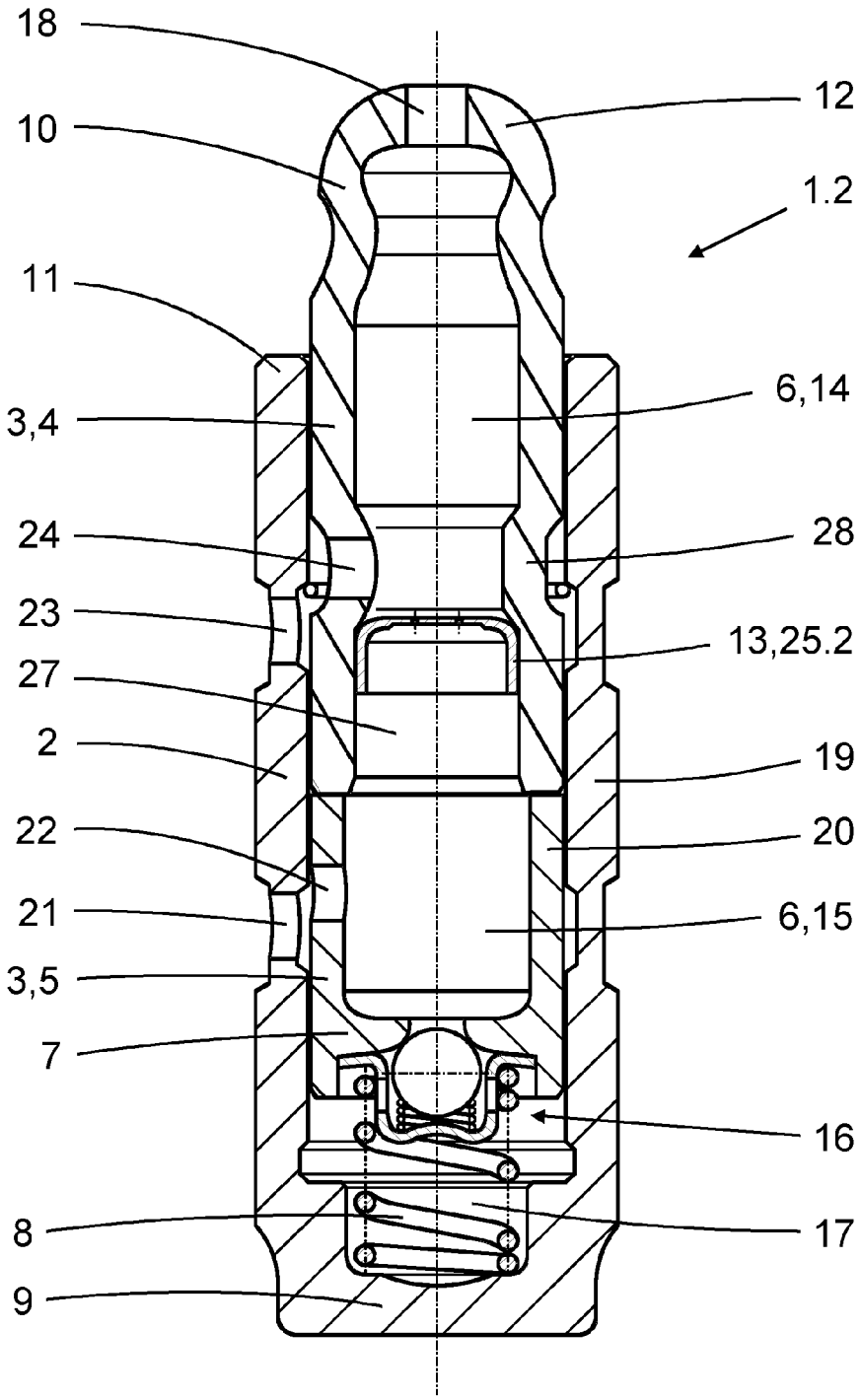
FIG. 2 shows a second variant of the first base embodiment of the support element formed according to the invention in a longitudinal central section.

In FIG. 2, a second variant of the first base embodiment of a hydraulic support element 1.2 according to the invention is represented in a longitudinal central section. In this variant as well, the partition element 13 is formed as a pot cylindrical cap 25.2 which, in the inner space 6 of the piston 3 with axially outward directed bottom wall 26 which in an inner cylindrical section 27 of the side wall 20 of the piston 3, is pressed until it is in contact with an inner constriction 28 of same.

Figure 2A:
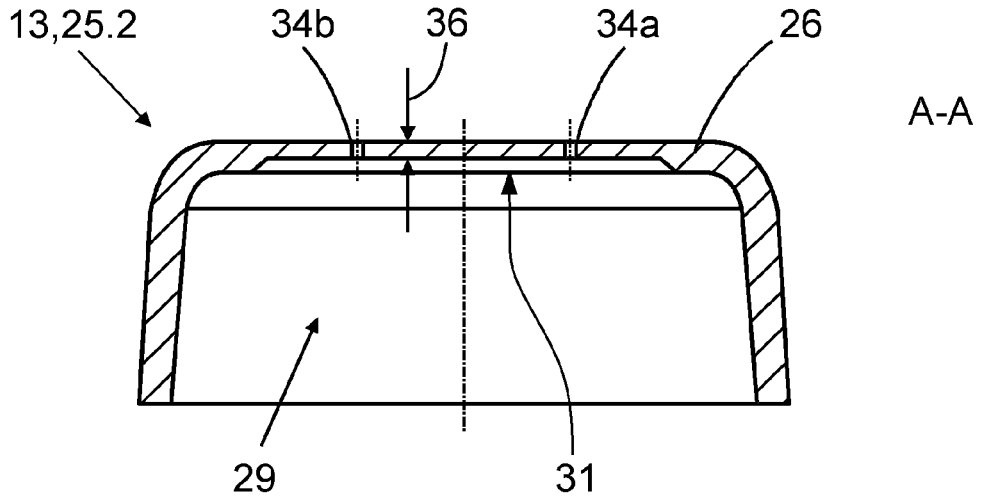
FIG. 2*a* shows the partition element of the support element according to FIG. 2 in an enlarged longitudinal central section.
Figure 2B:
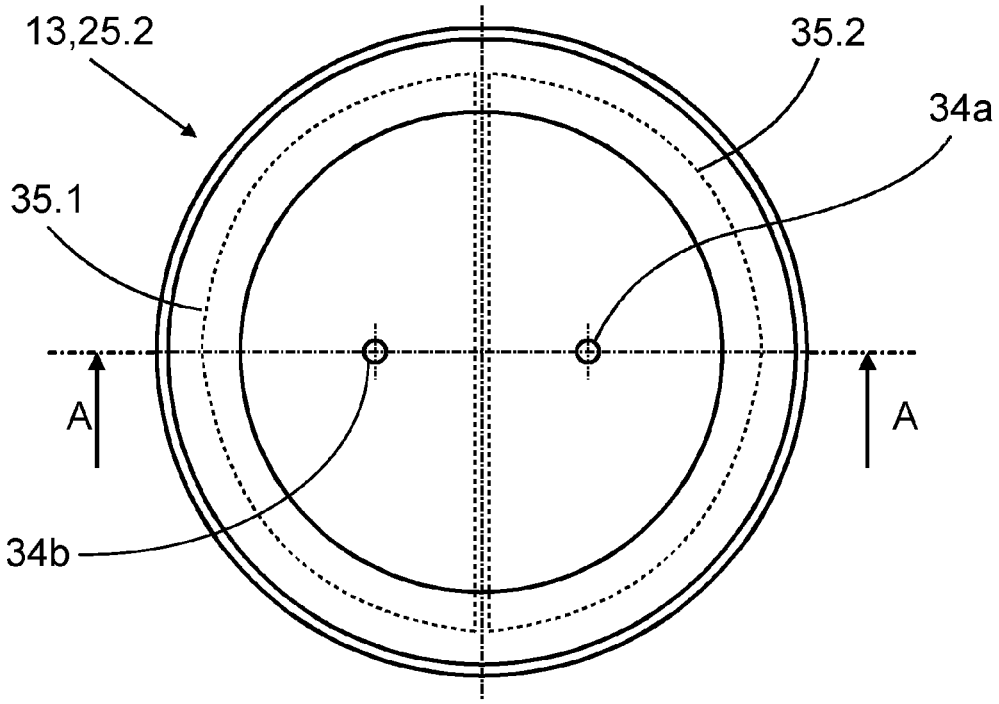
FIG. 2*b* shows the partition element of the support element according to FIGS. 2 and 2*a* in an enlarged axial view.

However, in contrast to the first variant according to FIGS. 1 to 1*b*, the ventilation opening 30 of the cap 25.2 is now formed by several cylindrical bores 34*a*, 34*b*, which are arranged in a regular distribution in the bottom wall 26 of the cap 25.2, each in the centroid of the surface of the associated wall sector 35.1, 35.2, which can be seen particularly well in the longitudinal central section of the enlarged representation in FIG. 2*a* and in the axial top view of the enlarged representation in FIG. 2*b* of the cap 25.2. In these FIGS. 2*a*, 2*b*, it is quite visible that, in this embodiment example, the recess 31 of the bottom wall 26 of the cap 25.2 is generated, in connection with preserving the outer contour, by a reduced wall thickness 36 of the bottom wall 26.

The production of the bore 32 in the cap 25.1 according to FIGS. 1, 1*a* and 1*b* as well as of the bores 34*a*, 34*b* in the cap 25.2 according to FIGS. 2, 2*a* and 2*b*, can in each case occur by drilling using a spiral drill, by punching out with a punching tool or by cutting out with a laser.

Figure 3:
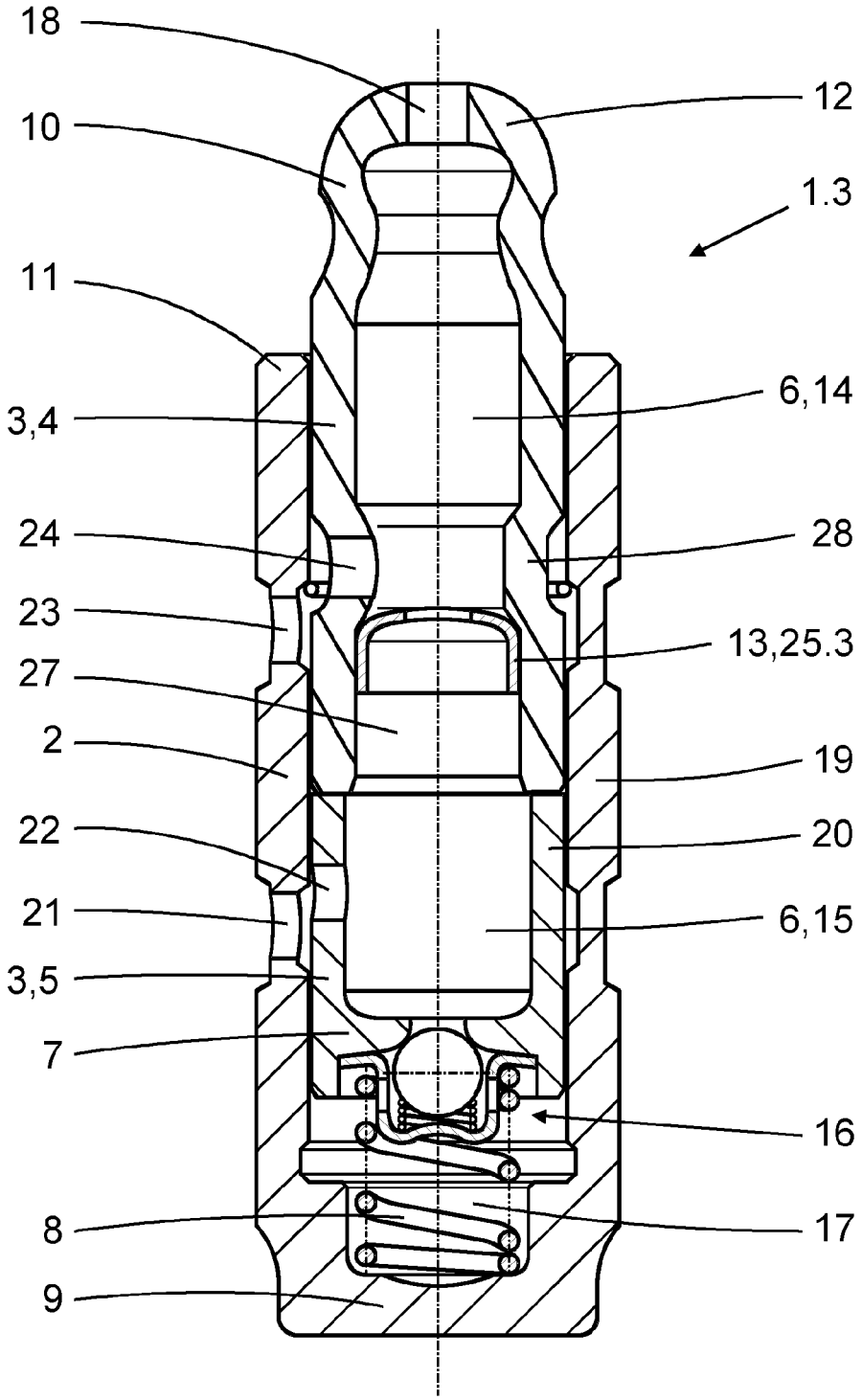
FIG. 3 shows a third variant of the first base embodiment of the support element formed according to the invention in a longitudinal central section.
Figure 3A:
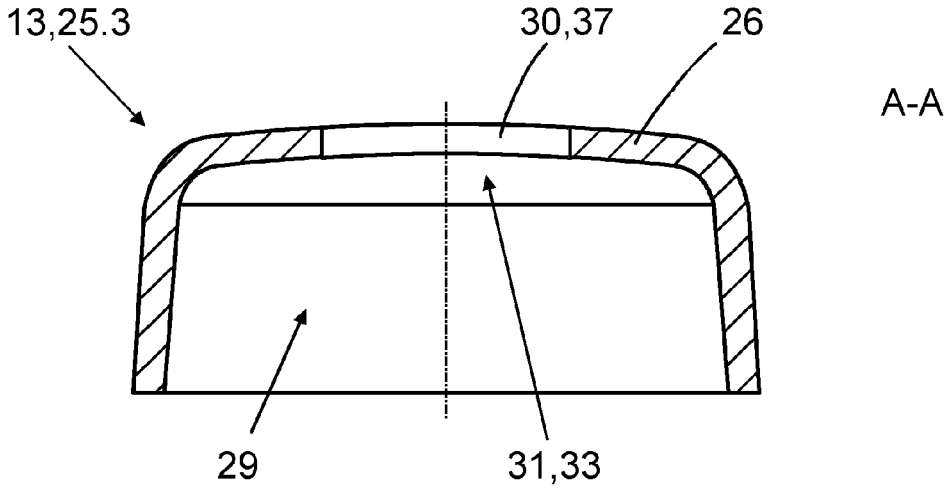
FIG. 3*a* shows the partition element of the support element according to FIG. 3 in an enlarged longitudinal central section.

In FIG. 3, a third variant of the first base embodiment of a hydraulic support element 1.3 according to the invention is represented in a longitudinal central section. In this variant, the partition element 13 is also formed as a pot cylindrical cap 25.3 which, in the inner space 6 of the piston 3 with axially outward directed bottom wall 26 in an inner cylindrical section 27 of the side wall 20 of the piston 3, is pressed until it comes in contact with an inner constriction 28 of the piston 3. In FIG. 3*a*, the cap 25.3 is represented in an enlarged longitudinal section and in FIG. 3*b* in an enlarged axial view.

However, in contrast to the first variant according to FIGS. 1 to 1*b* and the second variant according to FIGS. 2 to 2*b*, the ventilation opening 30 of the cap 25.3 is now formed by a slit 37, which is arranged diagonally and centered in the bottom wall 26 of the cap 25.3. The production of the slit 37 here has occurred by cutting out with a laser. The inner recess 31 of the bottom wall 26 of the cap 25.3, as in the first variant according to FIGS. 1 to 1*b*, is generated by an axially outward directed camber 33 of the bottom wall 26.

Figure 4:
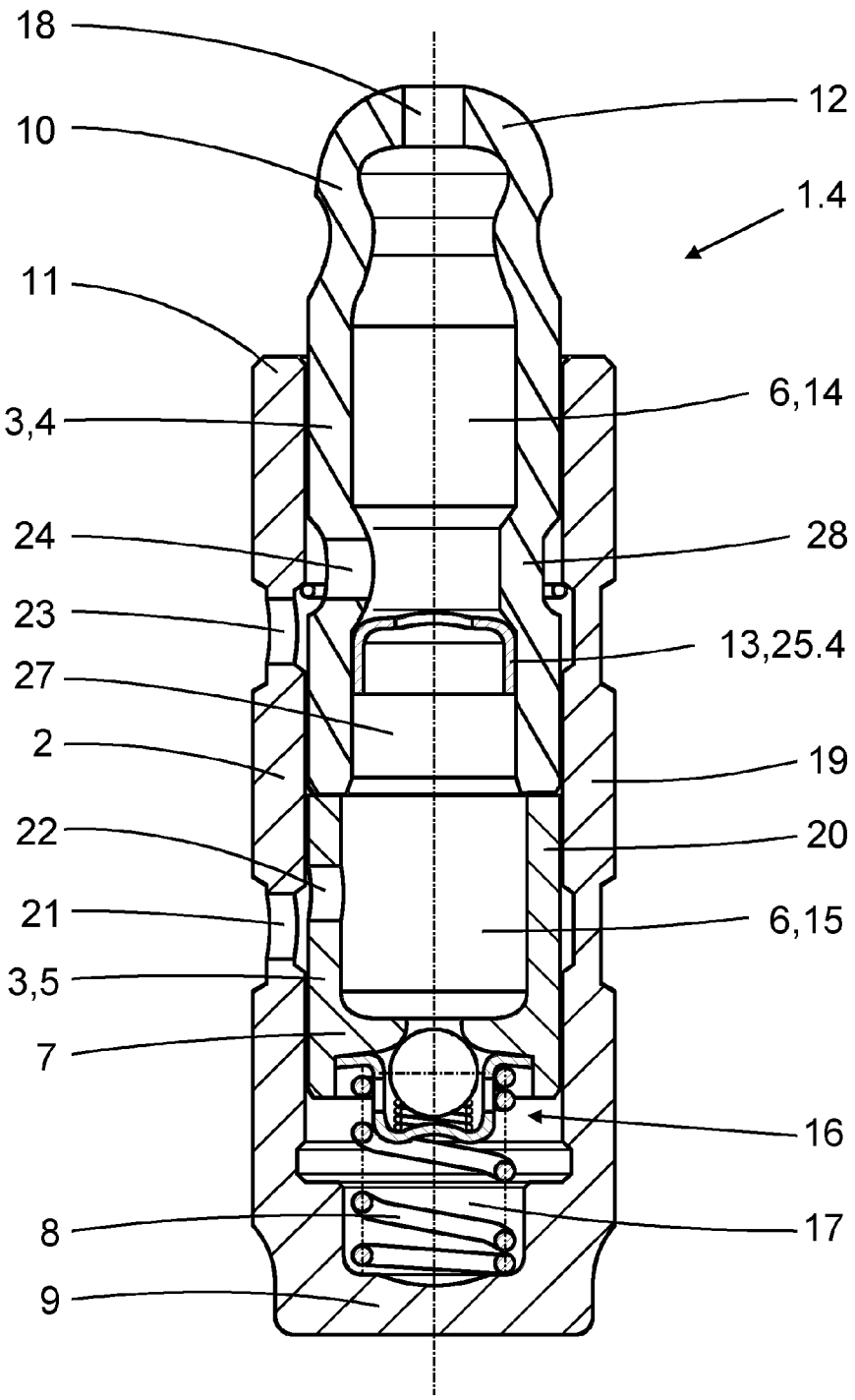
FIG. 4 shows a fourth variant of the first base embodiment of the support element formed according to the invention in a longitudinal central section.
Figure 4A:
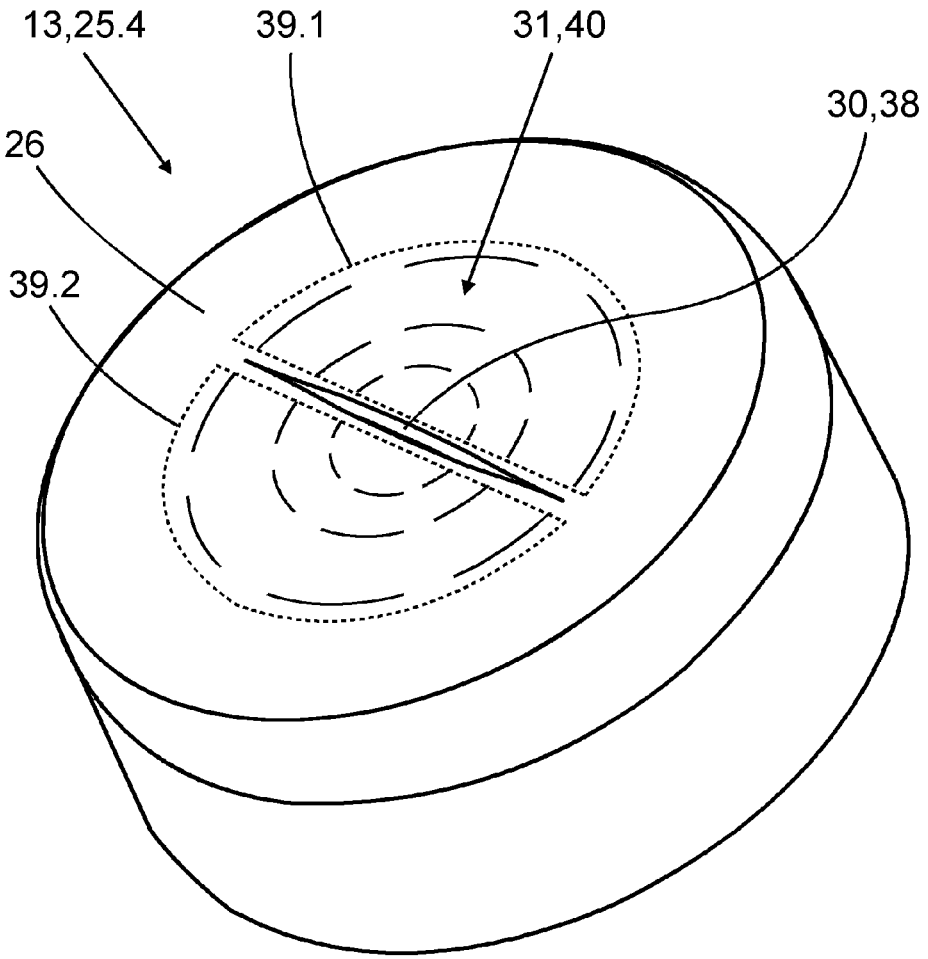
FIG. 4*a* shows the partition element of the support element according to FIG. 4 in an enlarged perspective view.

In FIG. 4, a fourth variant of the first base embodiment of a hydraulic support element 1.4 according to the invention is represented in a longitudinal central section. In this variant as well, the partition element 13 is formed as a pot cylindrical cap 25.4 which, in the inner space 6 of the piston 3 with axially outward directed bottom wall 26 in an inner cylindrical section 27 of the side wall 20 of the piston 3, is pressed in until it comes in contact with an inner constriction 28 of same. In FIG. 4*a*, the cap 25.4 is represented in an enlarged perspective view.

Figure 3B:
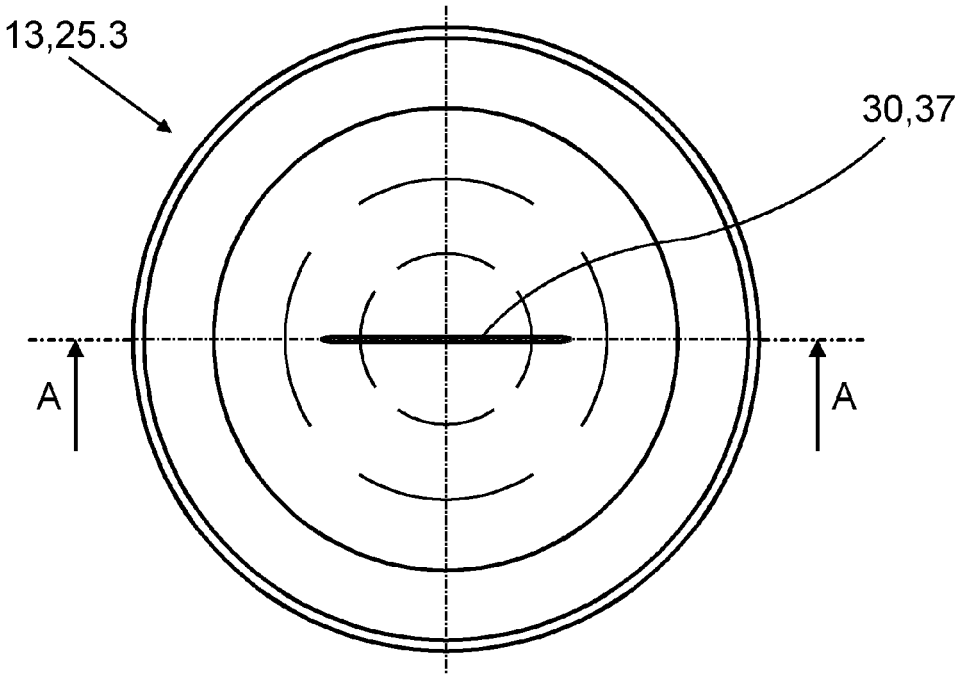
FIG. 3*b* shows the partition element of the support element according to FIGS. 3 and 3*a* in an enlarged axial view.

As in the third variant according to FIGS. 3 to 3*b*, the ventilation opening 30 is also formed by a slit 38, which is arranged diagonally and centered in the bottom wall 26 of the cap 25.4. However, in this embodiment, the production of the slit 38 has occurred by sheering open the bottom wall 26 and at least partial bending back of the wall sections 39.1, 39.2 in question with a punching and pressing tool. The inner recess 31 of the bottom wall 26 of the cap 25.4 is formed, in this example, by an axially outward directed camber 40 of at least one wall section 39.1 of the bottom wall 26.

Figure 5:
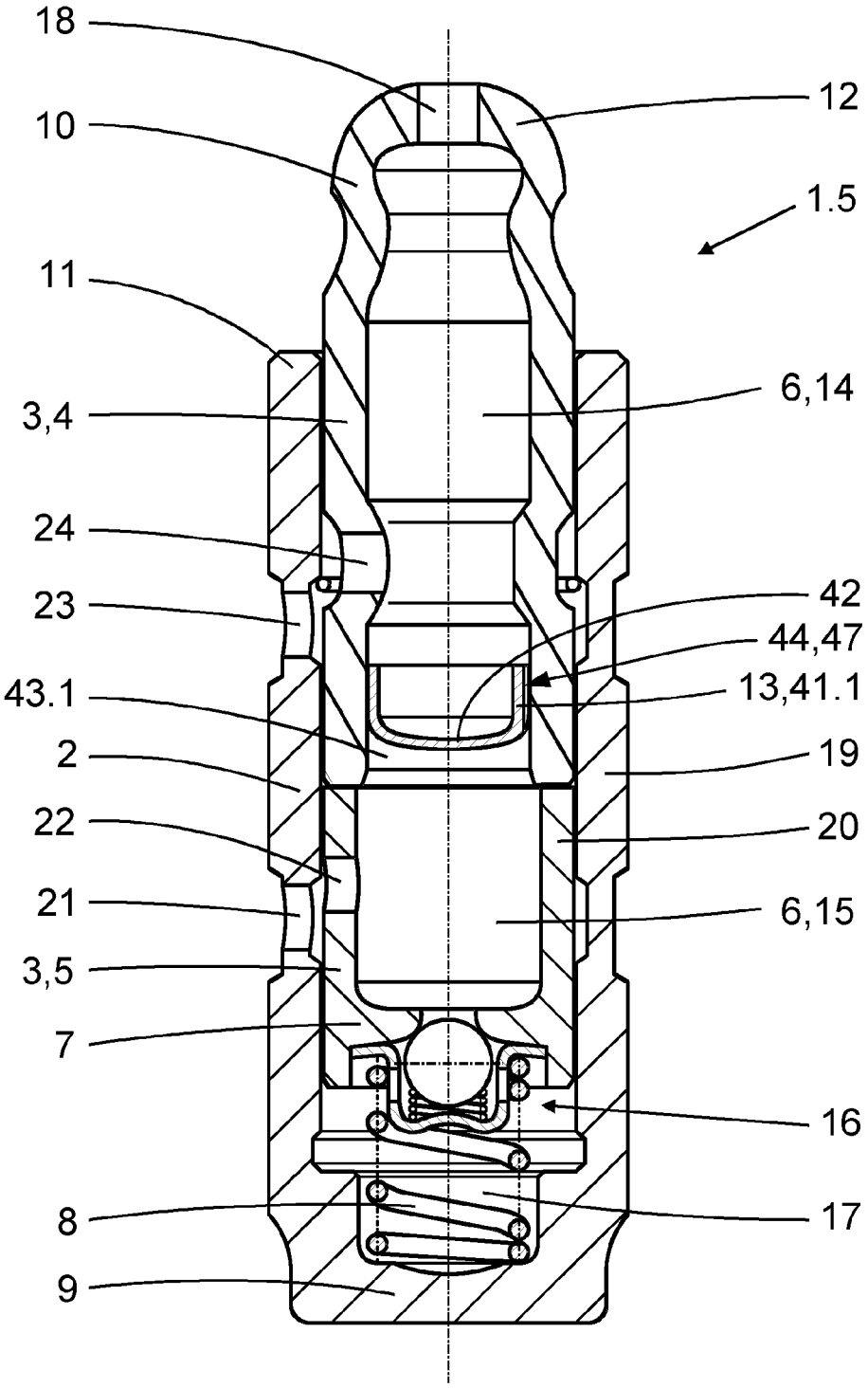
FIG. 5 shows a first variant of a second base embodiment of the support element formed according to the invention in a longitudinal central section.

In FIG. 5, a first variant of a second base embodiment of a hydraulic support element 1.5 according to the invention is represented in a longitudinal central section, which is provided for a valve drive of a combustion engine. The structure of the second base embodiment of the support element 1.5 corresponds largely to that of the first base embodiment of the support element 1.1-1.4 according to FIGS. 1 to 4. Therefore, the same reference numerals are used for identical components. The following description is essentially a description of the differences in comparison to the first base embodiment of the support element 1.1-1.4.

In this support element 1.5 as well, the partition element 13 is formed as a pot cylindrical cap 41.1, except that, in the inner space 6 of the piston 3 with axially inward directed cambered bottom wall 42 largely centered in an inner cylindrical section 43.1 of the side wall 20 of the piston 3, it is pressed in with a height that projects axially on both sides past the cap 41.1. Air bubbles and hydraulic oil foamed with air located in the supply-pressure space 15 thus accumulate preferably on the margin of the cap 41.1 between its bottom wall 42 and the cylindrical side wall 20 of the piston 3.

In order to discharge the air and the foamed hydraulic oil into the switching-pressure space 14, a ventilation channel 44 is provided, which is axially aligned and arranged between the cylindrical side wall 45.1 of the cap 41.1 and the inner cylindrical section 43 of the side wall 20 of the piston 3. The cross section of the ventilation channel 44 is limited to a predetermined limit cross-sectional area, in order to prevent an exchange of hydraulic oil and pressure variations between the supply-pressure space 15 and the switching-pressure space 14. In order to promote the flow of air and foamed hydraulic oil to the ventilation channel 44, an outer bulge 46 is provided on the bottom wall 42 of the cap 41.1, which is arranged or formed centered.

Figure 5A:
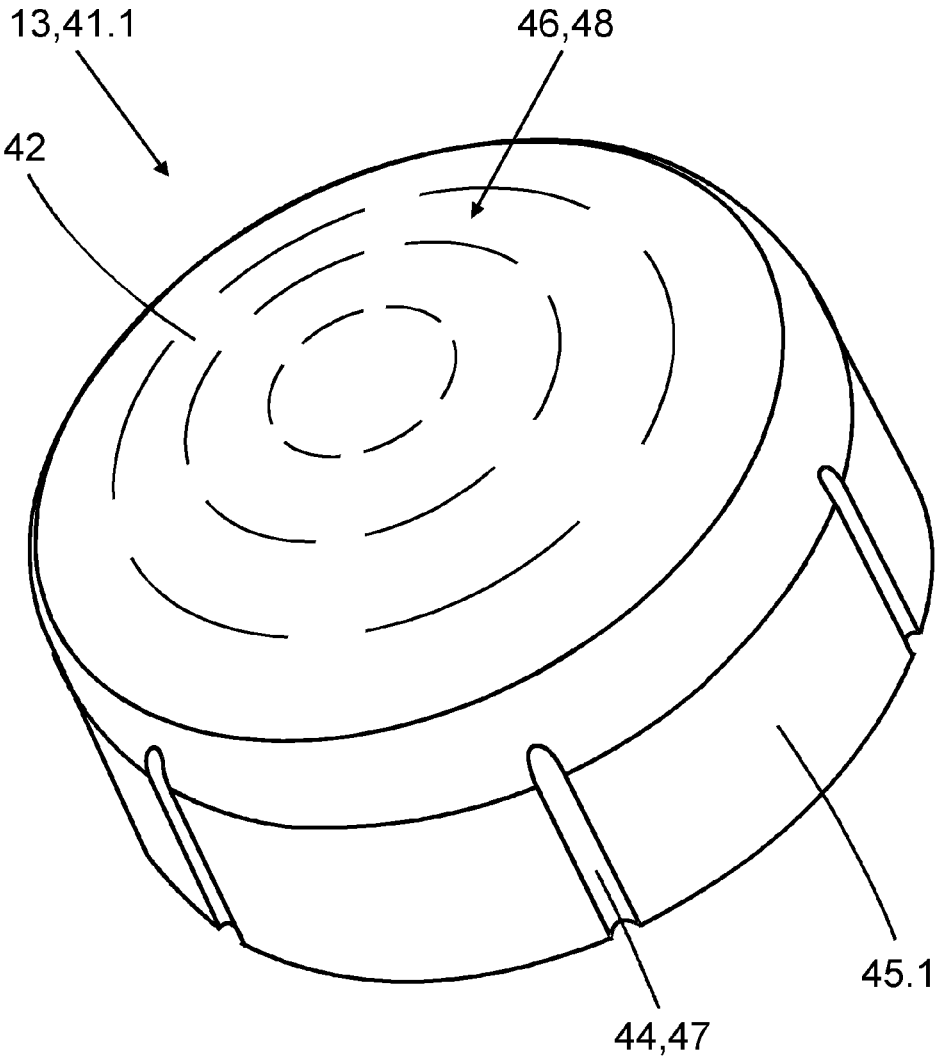
FIG. 5*a* shows the partition element of the support element according to FIG. 5 in an enlarged perspective view.

As one can see particularly well in the enlarged perspective view of the cap 41.1 shown in FIG. 5*a*, in this embodiment example the mentioned ventilation channel 44 is formed by several axial grooves 47 which are arranged in a regular distribution over the circumference in the cylindrical side wall 45.1 of the cap 41.1. The inner cylindrical section 43 of the side wall 20 of the piston 3, on the other hand, has a smooth cylindrical design as shown in FIG. 5. The production of the axial grooves 47 on the cap 41.1 can occur by pressing in with a pressing tool or by rolling in with a rolling tool. The outer bulge 46 of the bottom wall 42 of the cap 41.1 is preferably generated by an axially outward directed camber 48 of the bottom wall 42.

Figure 6:
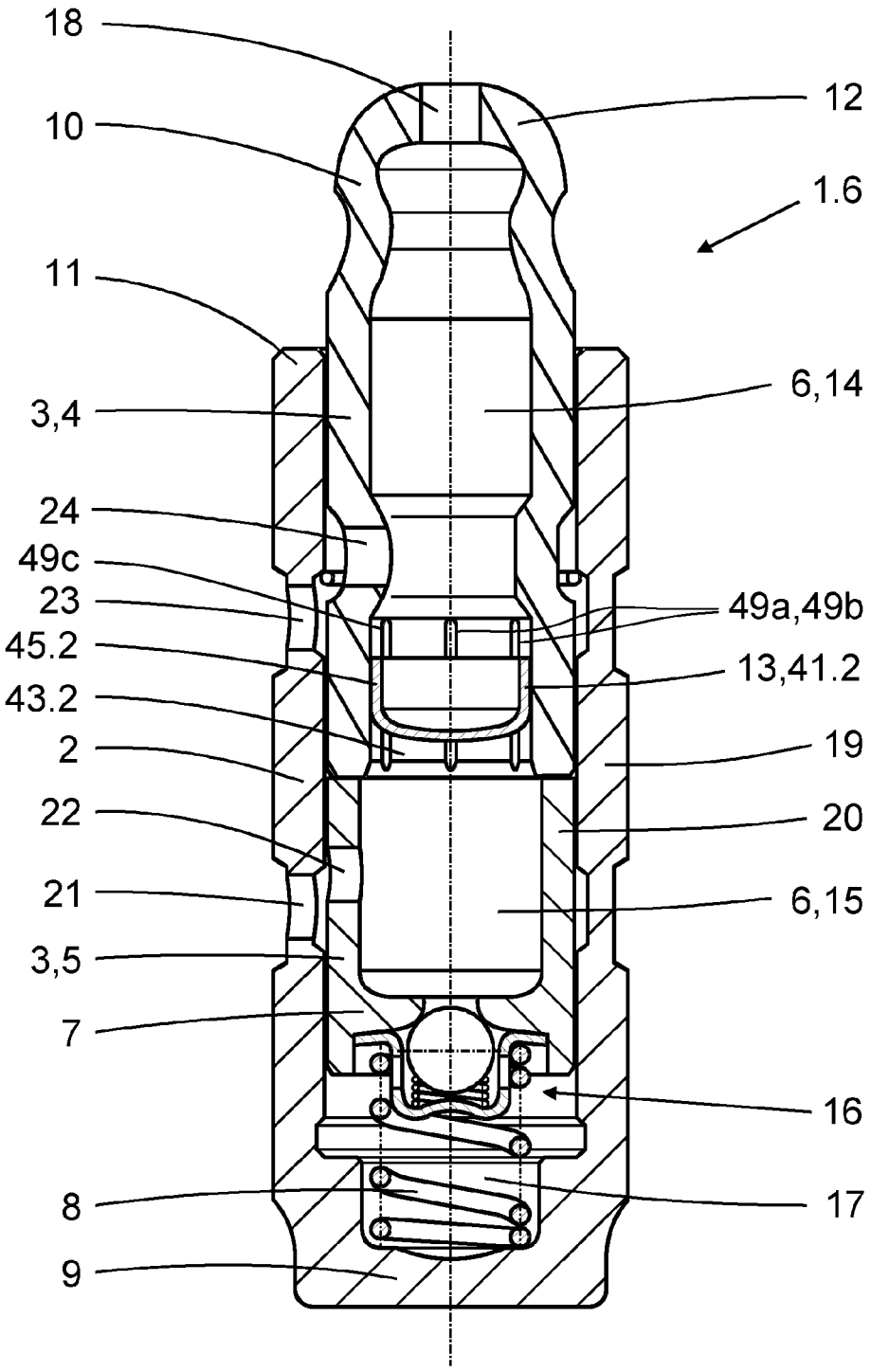
FIG. 6 shows a second variant of the second base embodiment of the support element formed according to the invention in a longitudinal central section.

In FIG. 6, a second variant of the second base embodiment of a hydraulic support element 1.6 according to the invention is represented in a longitudinal central section. In this variant as well, the partition element 13 is formed as a pot cylindrical cap 41.2 which, in the inner space 6 of the piston 3 with axially inward directed bottom wall 42 largely centered in an inner cylindrical section 43.2 of the side wall 20 of the piston 3, is pressed in with a height projecting axially on both sides past the cap 41.2.

Figure 6A:
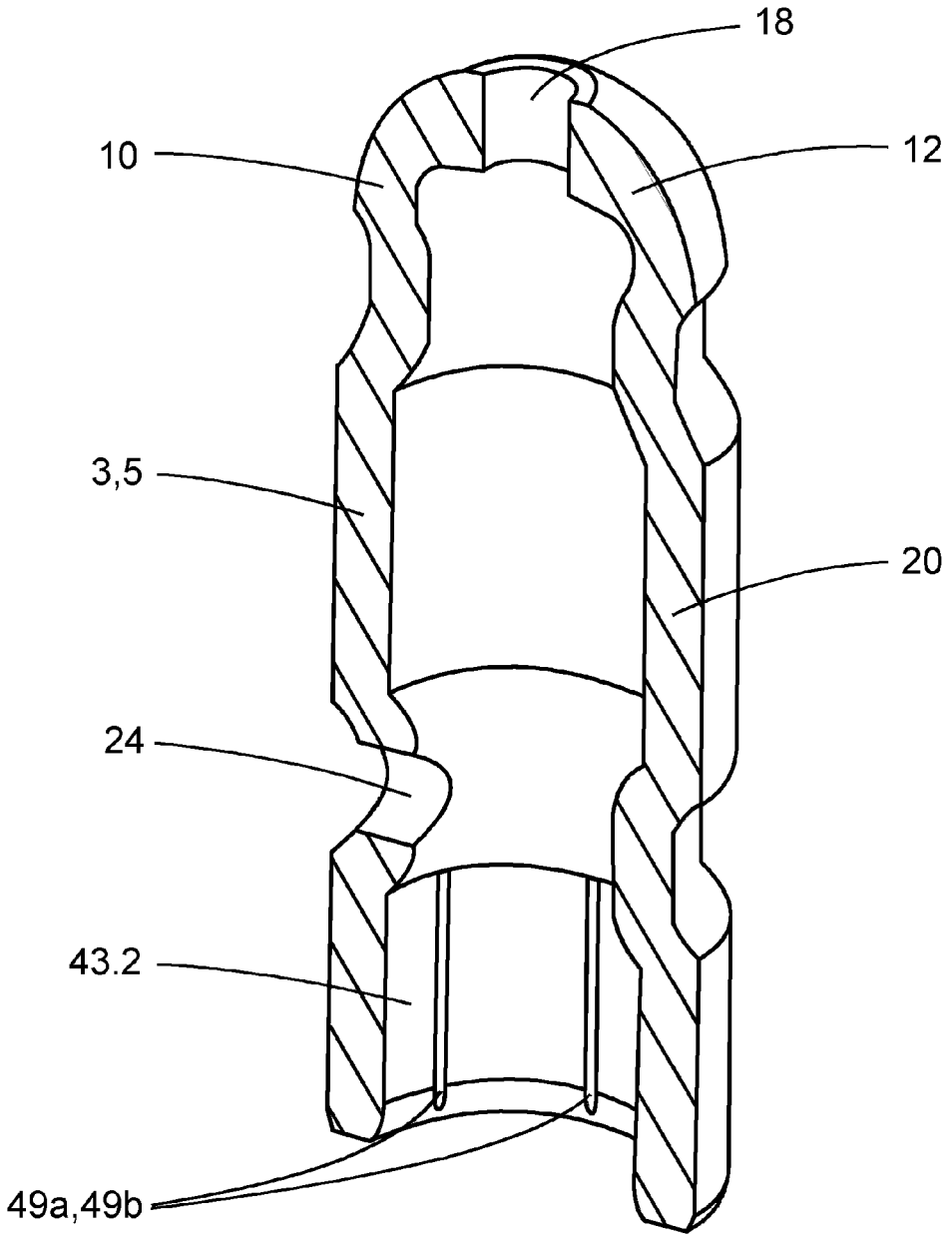
FIG. 6*a* shows the embodiment of a piston of the support element according to FIG. 6 in a perspective longitudinal central section.

However, in contrast to the first variant of the second base embodiment of a support element according to FIGS. 5 and 5*a*, the ventilation channel 44 is now formed by several axial grooves 49*a*, 49*b*, 49*c*, which are arranged in a regular distribution over the circumference in the inner cylindrical section 43.2 of the side wall 20 of the piston 3, and which project axially on both sides past the cap 41.2, which can be seen particularly well in the perspective longitudinal section represented in FIG. 6*a*. The cylindrical side wall 45.2 of the cap 41.2, on the other hand, has a smooth cylindrical design. The production of the axial grooves 49*a*, 49*b*, 49*c* can occur by machining out with a machining tool or by rolling in with a rolling tool. In this embodiment as well, the outer bulge 46 of the bottom wall 42 of the cap 41.2 is generated preferably by an axially outward directed camber 48 of the bottom wall 42.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

REFERENCE NUMERALS

1.1-1.6 Hydraulic support element
2 Casing
3 Piston
4 Inner portion of piston 3
5 Outer portion of piston 3
6 Inner space of piston 3
7 Inner end of piston 3
8 Spring
9 Bottom wall of casing 2
10 Outer end of piston 3
11 Outer margin of casing 2
12 Bearing head
13 Partition element
14 Switching-pressure space
15 supply-pressure space
16 Non-return valve
17 High-pressure space
18 Central bore
19 Side wall of casing 2
20 Side wall of piston 3
21 First opening of casing 2
22 First opening of piston 3
23 Second opening of casing 2
24 Second opening of piston 3
25.1-25.4 Cap
26 Bottom wall of cap 25.1-25.4
27 Inner cylindrical section of side wall 20
28 Inner constriction of side wall 20
29 Inner space of cap 25.1-25.4
30 Ventilation opening of cap 25.1-25.4
31 Inner recess of bottom wall 26
32 Bore
33 Camber of bottom wall 26
34*a*, 34*b* Bores
35.1, 35.2 Wall sector of bottom wall 26
36 Reduced wall thickness of bottom wall 26
37 Slit
38 Slit
39.1, 39.2 Wall section of bottom wall 26
40 Camber of wall section 39.1
41.1, 41.2 Cap
42 Bottom wall of cap 41.1, 41.2
43.1, 43.2 Inner cylindrical section of 20
44 Ventilation channel
45.1, 45.2 Side wall of cap 41.1, 41.2
46 Bulge on bottom wall 42
47 Axial groove in the cap 41.1
48 Camber of bottom wall 42
49*a*-49*c* Axial grooves

The invention claimed is:

1. A hydraulic support element for a valve drive of a combustion engine, comprising:
- a cylindrical casing;
- a hollow cylindrical piston guided axially movably therein, having:
  - an inner end supported by a spring on a bottom wall of the cylindrical casing;
  - an outer end projecting past an outer margin of the cylindrical casing formed as a hemispherical bearing head;
  - a partition element formed as a cylindrical cap disposed within an inner space of the cylindrical piston, having an inner recess centrally arranged in a bottom wall of the partition element:
  - the partition element pressed in to a radially inner constriction of a side wall of the cylindrical piston subdividing the inner space into an axially inner supply pressure space and an axially outer switching pressure space;
  - wherein the switching-pressure space is connected by a central bore arranged in the bearing head to a switching-pressure line of a switchable rocker arm;
  - a plurality of ventilation openings centrally arranged in the bottom wall of the partition element between the axially inner supply pressure space and the axially outer switching pressure space, each of the plurality of ventilation openings having a cross sectional area that does not exceed a predetermined limit; and
- a non-return valve connecting the axially inner supply pressure space to a high-pressure space enclosed between the inner end of the cylindrical piston and the bottom wall of the cylindrical casing.

2. The support element according to claim 1, wherein the plurality of ventilation openings is formed by a plurality of cylindrical bores.

3. The support element according to claim 2, wherein the plurality of cylindrical bores are formed by one of drilling with a spiral drill, punching out with a punching tool, and cutting out with a laser.

4. The support element according to claim 1, wherein the inner recess configured on the bottom wall of the partition element is formed by an axially outward directed camber of the bottom wall.

5. The support element according to claim 1, wherein the inner recess configured on the bottom wall of the partition element is formed by a reduced wall thickness of the bottom wall.

6. The support element according to claim 1, wherein the predetermined limit of the cross-sectional area of each of the plurality of ventilation openings is 0.25 $mm^2$.

7. A hydraulic support element for a valve drive of a combustion engine, comprising:
- a cylindrical casing;
- a hollow cylindrical piston guided axially movably therein, having:
  - an inner end supported by a spring on a bottom wall of the cylindrical casing; and,
  - an outer end projecting past an outer margin of the cylindrical casing and formed as a hemispherical bearing head;
- a partition element formed as a cylindrical cap disposed within an inner space of the cylindrical piston, having an inner recess centrally arranged in a bottom wall of the partition element;

the partition element pressed in to a radially inner constriction of a side wall of the cylindrical piston subdividing the inner space into an axially inner supply pressure space and an axially outer switching pressure space;

wherein the switching-pressure space is connected by a central bore arranged in the bearing head to a switching-pressure line of a switchable rocker arm;

a ventilation opening formed as a slit arranged diagonally and centered in the bottom wall of the partition element; and a non-return valve connecting the supply pressure space to a high-pressure space enclosed between the inner end of the cylindrical piston and the bottom wall of the cylindrical casing.

8. The support element according to claim 7, wherein the slit is formed by one of cutting out with a laser, and shearing open of the bottom wall of the partition element with at least partial bending back of wall sections with a punching and pressing tool.

9. A hydraulic support element for a valve drive of a combustion engine, comprising:

a cylindrical casing and a hollow cylindrical piston guided axially movably therein;

the hollow cylindrical piston having:

an axially inner end supported by a spring on a bottom wall of the cylindrical casing;

an axially outer end formed as a hemispherical bearing head that projects past an outer margin of the cylindrical casing; and an inner space subdivided by a partition element into an axially inner supply pressure space and an axially outer switching-pressure space;

wherein the axially inner supply pressure space is connected by a non-return valve to a high-pressure space enclosed between the axially inner end of the hollow cylindrical piston and the bottom wall of the cylindrical casing;

wherein the axially outer switching-pressure space is arranged to connect to a switching pressure line of a switchable rocker arm, by a central bore in the hemispherical bearing head;

the partition element formed as a cylindrical cap arranged in the inner space of the hollow cylindrical piston with an axially inward directed bottom wall of the partition element in an inner cylindrical section of a side wall of the hollow cylindrical piston pressed in with an axial height that projects past the cylindrical cap, the partition element having:

a ventilation channel, which is oriented axially and arranged between a side wall of the partition element and the inner cylindrical section of the side wall of the hollow cylindrical piston, the ventilation channel having a cross sectional area that does not exceed a predetermined limit; and an outer bulge on the bottom wall of the partition element, which is centrally arranged.

10. The support element according to claim 9, wherein the ventilation channel is formed by a plurality of axial grooves arranged in a regular distribution in the side wall of the partition element.

11. The support element according to claim 10, wherein the axial grooves are formed by pressing in with a pressing tool.

12. The support element according to claim 9, wherein the ventilation channel is formed by several axial grooves, which are arranged in a regular distribution over a circumference in the inner cylindrical section of the side wall of the cylindrical piston.

13. The support element according to claim 9, wherein the outer bulge in the bottom wall of the partition element is formed by an axially outward directed camber of the bottom wall of the partition element.

14. The support element according to claim 9, wherein the predetermined limit of the cross-sectional area of the ventilation channel is 0.25 $mm^2$.

* * * * *